US009614323B2

(12) United States Patent
Chen

(10) Patent No.: US 9,614,323 B2
(45) **Date of Patent: *Apr. 4, 2017**

(54) ELECTRICAL CONNECTOR

(71) Applicant: J.S.T. CORPORATION, Farmington Hills, MI (US)

(72) Inventor: Ping Chen, Farmington Hills, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 164 days.

This patent is subject to a terminal disclaimer.

(21) Appl. No.: 14/043,271

(22) Filed: Oct. 1, 2013

(65) Prior Publication Data

US 2015/0037996 A1 Feb. 5, 2015

Related U.S. Application Data

(60) Provisional application No. 61/860,528, filed on Jul. 31, 2013.

(51) Int. Cl.

| | |
|---|---|
| ***H01R 13/639*** | (2006.01) |
| ***H01R 13/641*** | (2006.01) |
| ***H01R 13/627*** | (2006.01) |
| ***H01R 13/64*** | (2006.01) |

(52) U.S. Cl.

CPC ..... *H01R 13/6273* (2013.01); *H01R 13/639* (2013.01); *H01R 13/64* (2013.01); *H01R 2201/26* (2013.01)

(58) Field of Classification Search

CPC H01R 13/641; H01R 13/639; H01R 13/7032; H01R 13/6273; H01R 13/6272; H01R 13/6275; H01R 13/6277; H01R 13/506; H01R 13/627; H01R 13/6397

USPC ..... 439/367, 188, 620, 352, 345, 353, 743

See application file for complete search history.

(56) References Cited

U.S. PATENT DOCUMENTS

| | | | | |
|---|---|---|---|---|
| 5,586,902 | A | 12/1996 | Hopf et al. | |
| 5,749,747 | A * | 5/1998 | Inaba et al. | 439/358 |
| 6,435,894 | B2 | 8/2002 | Little et al. | |
| 6,488,524 | B2 * | 12/2002 | Endo | 439/353 |
| 6,676,452 | B2 * | 1/2004 | Bolen et al. | 439/743 |
| 6,739,913 | B2 * | 5/2004 | Hayashi | 439/620.05 |
| 6,910,902 | B2 | 6/2005 | Osada | |
| 6,945,801 | B2 | 9/2005 | Brown | |

(Continued)

*Primary Examiner* — Amy Cohen Johnson
*Assistant Examiner* — Matthew T Dzierzynski
(74) *Attorney, Agent, or Firm* — Kratz, Quintos & Hanson, LLP

(57) ABSTRACT

An electrical connector having a squib connector housing a plurality of socket contacts and a squib assembly housing a plurality of pin contacts for insertion in the socket contacts when the squib connector and squib assembly are moved in a mating direction and mated. A retaining means provided for retaining the squib connector and squib assembly in a fully mated condition. A spring, acting in a direction opposite the mating direction, provides a resisting force to oppose mating. During the application of a mating force to overcome the resisting force of the spring and move the squib connector and squib assembly in the mating direction, and prior to the squib connector and squib assembly reaching the fully mated condition, removal of the resisting force of the spring is triggered and the mating force is applied to moving the squib connector and squib assembly to the fully mated condition.

7 Claims, 6 Drawing Sheets

(56) References Cited

U.S. PATENT DOCUMENTS

| | | | | |
|---|---|---|---|---|
| 6,997,750 | B2 | 2/2006 | Johannes et al. | |
| 7,229,305 | B2 * | 6/2007 | Hirschmann | 439/352 |
| 7,303,423 | B2 | 12/2007 | Hayashi et al. | |
| 9,071,015 | B1 * | 6/2015 | Tan et al. | |
| 2003/0162444 | A1 | 8/2003 | Hayashi | |
| 2008/0064250 | A1 * | 3/2008 | Lee et al. | 439/352 |
| 2012/0112762 | A1 * | 5/2012 | Odorfer et al. | 324/538 |
| 2014/0045361 | A1 * | 2/2014 | Gunreben et al. | 439/345 |

* cited by examiner

ELECTRICAL CONNECTOR

CROSS-REFERENCE TO RELATED APPLICATION

This application claims the benefit of priority of U.S. Provisional Application Ser. No. 61/860,528, filed Jul. 31, 2013, the entire content of which is incorporated herein by reference.

BACKGROUND OF THE INVENTION

1. Field of the Invention

In a motor vehicle inflatable airbag system, a squib assembly is used as a heat generator for feeding a gas into the airbag. The squib assembly is connected to a squib connector in order to supply electrical energy to the squib assembly. The present invention is a squib assembly and a squib connector having a configuration to assure complete mating of the squib assembly and the squib connector. With the present configuration, the prevention of incomplete mating is accomplished without the use of a CPA (Connector Position Assurance) or a "shorting clip", which are used for this purpose in many Prior Art connectors of this type. The present invention features a "Go/No Go" function to assure mating of the squib assembly and squib connector. The "Go/No Go" function is described below.

2. Discussion of the Relevant Art

U.S. Pat. Nos. 6,435,894, 6,945,801, 6,910,902, 6,997,750, 5,586,902, 6,739,913 and 7,303,423 and U.S. Published Application 20030162444 are directed to electrical connectors of the squib connector type, however they do not prevent incomplete mating in the manner of the present invention. The electrical connectors of the indicated patents and published application do not provide a "Go/No Go" function for assuring complete mating of the squib assembly and squib connector as does the present invention.

SUMMARY OF THE INVENTION

An electrical connector of the present invention has a squib connector of an electrical insulating material for housing a plurality of socket contacts, a squib assembly of an electrical insulating material for housing a plurality of pin contacts for insertion in the socket contacts when the squib connector and squib assembly are moved together in a mating direction and mated, a retaining means for retaining the squib connector and squib assembly in a fully mated condition, the retaining means is self activated when the squib connector and squib assembly are fully mated, and a spring, acting in a direction opposite the mating direction, provides a resisting force to oppose mating. During the application of a mating force to overcome the resisting force of the spring and move the squib connector and squib assembly in the mating direction, and prior to the squib connector and squib assembly reaching the fully mated condition, removal of the resisting force of the spring is triggered and the mating force is instantly applied to moving the squib connector and squib assembly to the fully mated condition, whereat the retaining means is activated.

In the electrical connector of the invention, the spring is formed to provide a resistance force when an upper portion of the spring is moved toward a lower portion of the spring, the upper portion of the spring bears on the squib connector, the squib assembly includes a ledge, and the lower portion of the spring bears on the ledge.

In the electrical connector of the invention, the squib connector includes a spring activator and during movement of the squib connector and squib assembly in the mating direction, the spring activator contacts the spring to displace the spring from the ledge, thereby removing the resisting force of the spring.

Further in the electrical connector of the invention, the retaining means has a lip on the squib assembly and a lock lever on the squib connector, the lock lever being biased toward the lip and free to engage the lip only when the squib connector and squib assembly are fully mated.

Further in the electrical connector of the invention, the spring is fabricated of a spring material having the form of a wire, with the wire being configured to be disposed substantially in a single plane.

Still further in another embodiment of the electrical connector of the invention, the spring is fabricated of a spring material having the form of a wire, with the wire being configured to have the lower portion and a part of the upper portion disposed substantially in a single plane, and a remaining part of the upper portion disposed in a plane perpendicular to the single plane.

DETAILED DESCRIPTION OF THE PREFERRED EMBODIMENT

The present invention is a squib assembly and a squib connector having a configuration to assure complete mating of the squib assembly and squib connector by providing a "Go/No Go" function when being mated.

In the following description of the invention, the inventive feature is described as it is incorporated into the squib assembly and squib connector, however the inventive feature is not necessarily limited to electrical connectors of this type.

Figure 2A:
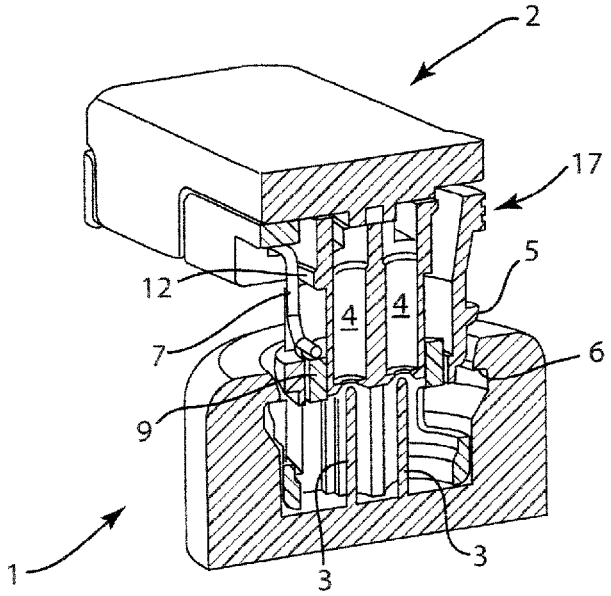
FIG. 2*a* is a perspective view of the squib connector and squib assembly of the electrical connector of the invention, having a portion in cross-section taken at section b-b shown in FIG. 1*a*, at an intermediate insertion position.
Figure 2B:
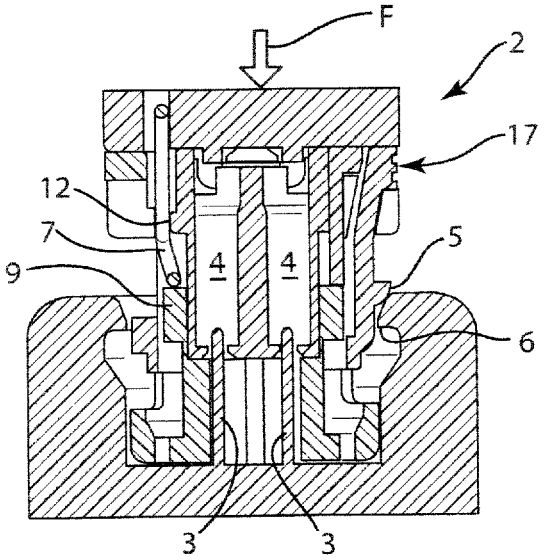
FIG. 2*b* is a cross-sectional view of the squib connector and squib assembly of the electrical connector of the invention, taken at section b-b shown in FIG. 1*a*, at the intermediate insertion position.
Figure 3A:
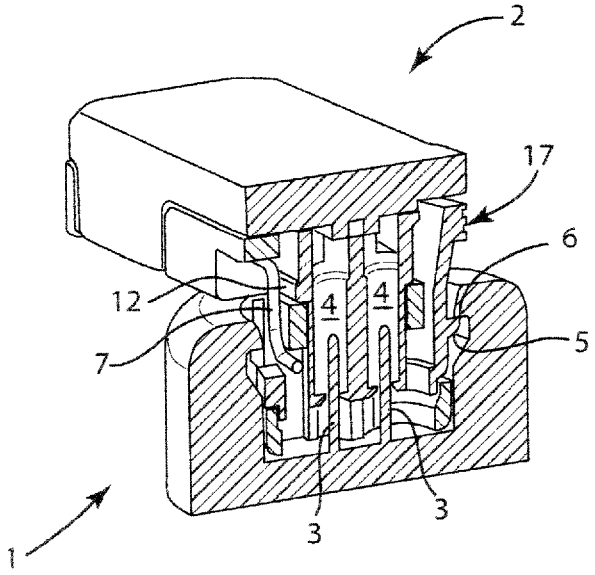
FIG. 3*a* is a perspective view of the squib connector and squib assembly of the electrical connector of the invention, having a portion in cross-section taken at section b-b shown in FIG. 1*a*, at a fully mated and locked insertion position.
Figure 3B:
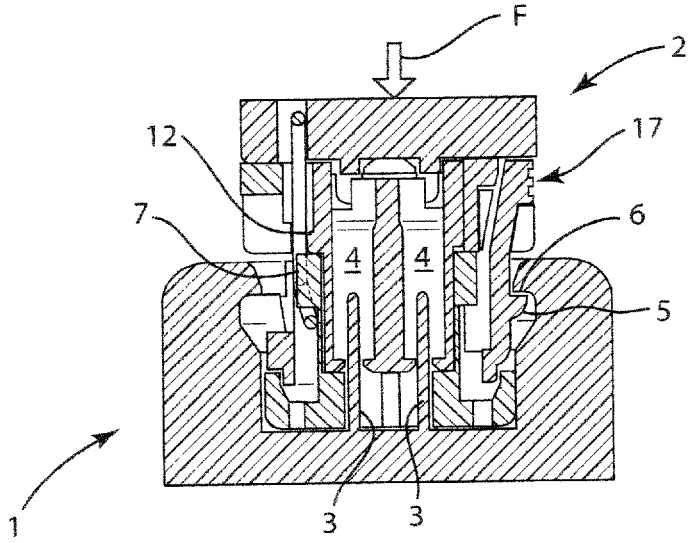
FIG. 3*b* is a cross-sectional view of the squib connector and squib assembly of the electrical connector of the invention taken at section b-b shown in FIG. 1*a*, at the fully mated and locked insertion position.

The electrical connector includes squib assembly 1 and squib connector 2, as shown in FIGS. 1*a*-3*b*. The squib assembly 1 is formed of an electrical insulating material and includes pin contacts 3. The squib connector is formed of an electrical insulating material and includes socket contacts 4 for accepting the pin contacts 3. The squib connector 2 is mated with the squib assembly 1 to a depth at which lock lever 5 on squib connector 2 engages lip 6 on squib assembly 1, as shown in FIGS. 3*a* and 3*b*. The lock lever and lip form a retaining means for retaining the components of the electrical connector in a fully mated condition.

The squib connector includes a spring 7. The spring is shown removed from the squib connector in FIG. 4. In FIGS. 1*a*-3*b*, only half of spring 7 is shown, as the drawings are cross-sectional views in order to more clearly show the components of the squib connector.

Figure 1A:
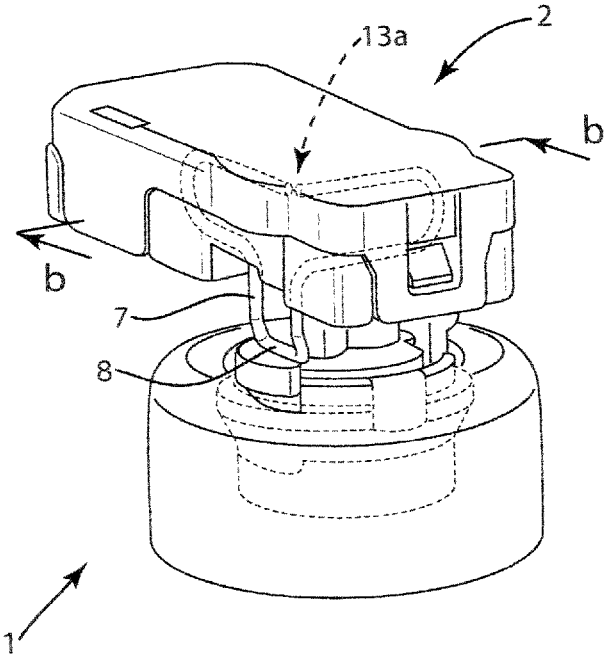
FIG. 1*a* is a perspective view of a squib assembly and a squib connector of the electrical connector of the invention, arranged at a pre-set insertion position.
Figure 1B:
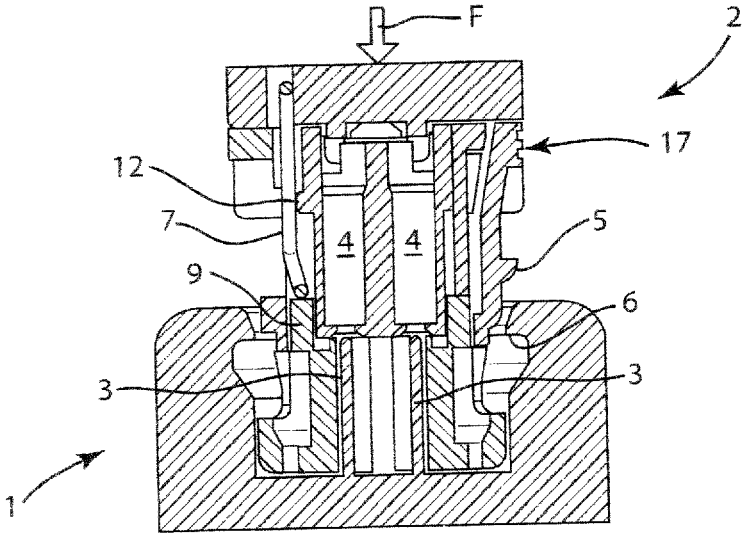
FIG. 1*b* is a cross-sectional view, taken at section b-b shown in FIG. 1*a*, of the squib assembly and squib connector of the electrical connector of the invention, arranged at the pre-set insertion position.
Figure 6:
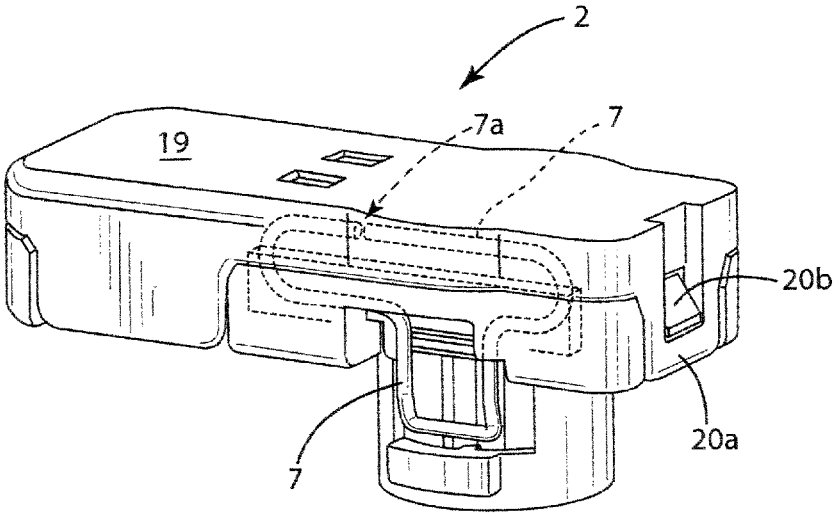
FIG. 6 is a perspective view of the squib connector of the invention, having a spring of the first embodiment and certain other internal components visible.
Figure 7:
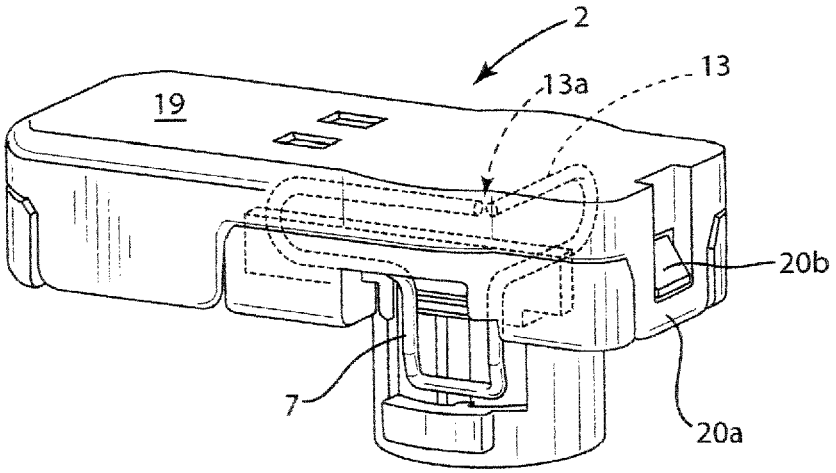
FIG. 7 is a perspective view of the squib connector of the invention, having the spring of the second embodiment and certain other internal components visible.

In FIGS. 1*a* and 1*b*, the squib connector and squib assembly are positioned at a pre-set position, in preparation for mating the squib connector and squib assembly. At this position, spring 7 has an un-deformed shape. The un-deformed shape is best shown in FIG. 6. A lower horizontal portion 8 of spring 7 bears against ledge 9, which is a component of the squib assembly 1. To mate the squib connector and squib assembly, force, as indicated at F in FIGS. 1*b*, 2*b* and 3*b*, is applied to the squib connector 2, while supporting the squib assembly 1.

Figure 4:
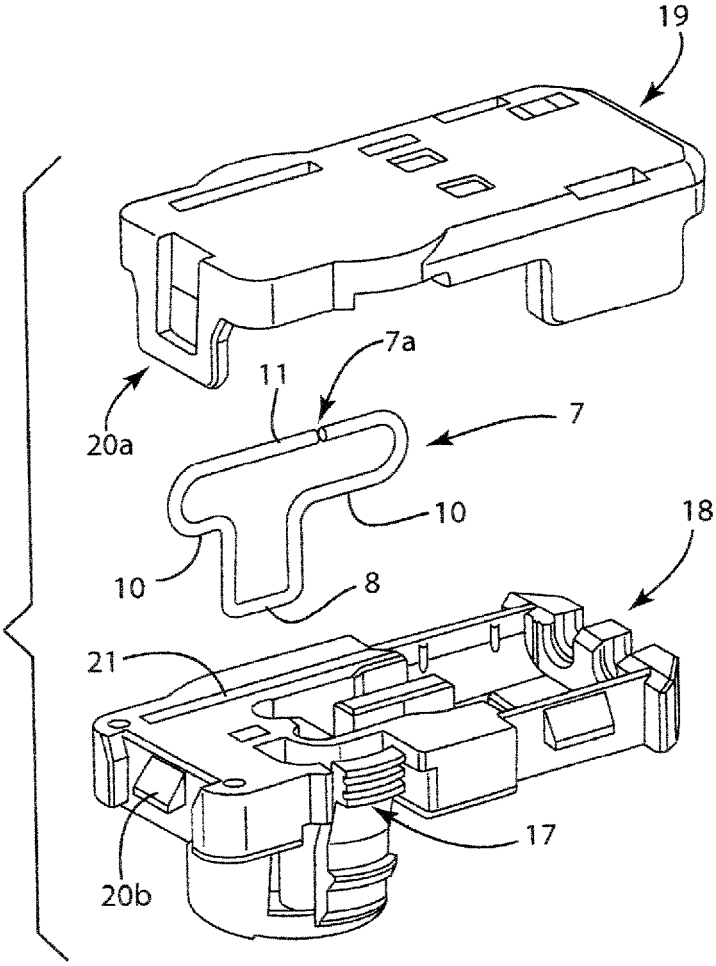
FIG. 4 is a perspective view of the squib connector of the invention, showing a spring and a cover removed from a body portion thereof.

As the force is applied, the squib connector and squib assembly progress toward engagement, as shown in various stages in FIGS. 1*a*-3*b*. During the stages shown in FIGS. 1*a*-3*b*, respectively, the spring 7 progressively deforms, with the reaction force of the spring, which opposes force F, attempting to separate the squib connector and squib assembly. Referring to FIG. 4, the spring is deformed in a manner in which a middle portion 10 of the spring approaches an upper portion 11 of the spring. Spring 7 is preferably formed of spring steel wire. A joint formed by ends of the wire is indicated at 7*a*.

As the squib connector and squib assembly are further mated, spring 7 continues to deform and increases in stored elastic energy. At the same time, spring actuator 12 moves downward, in relation to the squib assembly, but lower horizontal portion 8 of spring 7 does not move downward because it is bearing against ledge 9 of the squib assembly 1. As shown in FIGS. 2*a* and 2*b*, spring activator 12 is approaching lower horizontal portion 8 of spring 7, which is bearing on ledge 9. When spring activator 12 passes behind lower horizontal portion 8 of spring 7, the lower horizontal portion 8 of spring 7 is displaced from ledge 9 by the spring activator and the spring returns to its original un-deformed shape. The displacement of spring 7 from ledge 9 takes place as lock lever 5 is at its maximum deflection and is about to engage lip 6.

When lower horizontal portion 8 of spring 7 is displaced from ledge 9, force F is no longer opposed by the spring, and the entire force F is instantly applied to driving squib connector 2 into squib assembly 1, at which point lock lever 5 engages lip 6. The retaining means, lock lever 5, is self-activating on lip 6. That is lock lever 5 is biased toward lip 6, and engages lip 6 when it clears lip 6, as the squib connector and squib assembly are fully mated.

Lower horizontal portion 8 of spring 7, following its displacement from ledge 9, rests beneath ledge 9 in a recess, as shown in FIG. 3*b*. In the area of the ledge, clearance must be provided for the spring to be displaced from the ledge and freely return to its original un-deformed shape.

Complete mating of the squib connector and squib assembly is assured, because if the lock lever 5 does not engage lip 6, the squib connector will be automatically rejected away form the squib assembly by action of the spring. This automatic rejection is referred to as "No Go" of the "Go/No Go" function. If lock lever 5 engaged lip 6, when the squib connector and squib assembly are fully mated, it is considered as "Go". The distinguishing "Go/No Go" feature ensures the electrical connector system is either fully and correctly mated, or completely separated. No grey zone can exist when mating the squib connector and squib assembly. Thus an incomplete mating condition is avoided.

Figure 5:
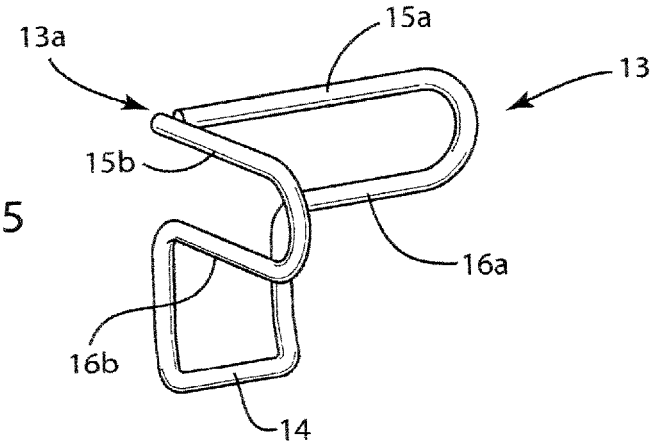
FIG. 5 is a perspective view of a second embodiment of the spring portion of the squib connector of the invention.

In a second embodiment of the connector the spring has an un-deformed shape as shown in FIG. 5, at 13. Referring to FIG. 5, a lower horizontal portion 14 of spring 13 has a shape substantially similar to the lower horizontal portion 8 of spring 7 and the lower horizontal portion 14 bears on ledge 9, as in the first embodiment. The lower horizontal portion 14 of spring 13 functions the same way as in the first embodiment. The upper portion of spring 13 has portions 15*a* and 15*b*, which are directed at substantially 90° to each other. The configuration of spring 13 of the second embodiment is in contrast to spring 7, which preferably is arranged in a single plane. As in the first embodiment the portions 16*a* and 16*b* of spring 13 must be free to deflect when force is applied to mate squib connector 2 with squib assembly 1. As the spring of the first embodiment, the spring of the second embodiment is formed of spring steel wire. A joint formed by ends of the wire is indicated at 13*a* in FIG. 5.

In practice of the invention, springs 7 and 13 are preferably fabricated from spring steel wire or another metal wire. However, they can be made of engineered plastics rather than metal. The springs are preferably in the form of a wire, with the joint formed by ends of the wire located as shown in FIGS. 4 and 5.

As shown in FIG. 4, the squib connector can be molded to include two parts. In FIG. 4, a body 18 of the squib connector is shown having a cover 19, which can be held in place by a retainer mechanism, such as 20*a* and 20*b*, on each end of the cover and body. In FIG. 4, spring 7 is shown as being removable from groove 21. If a spring as found in the second embodiment is used, a groove having an "L" shape is used. FIG. 1*a* shows a squib connector having spring 13 in an "L" shaped groove.

Figure 8:
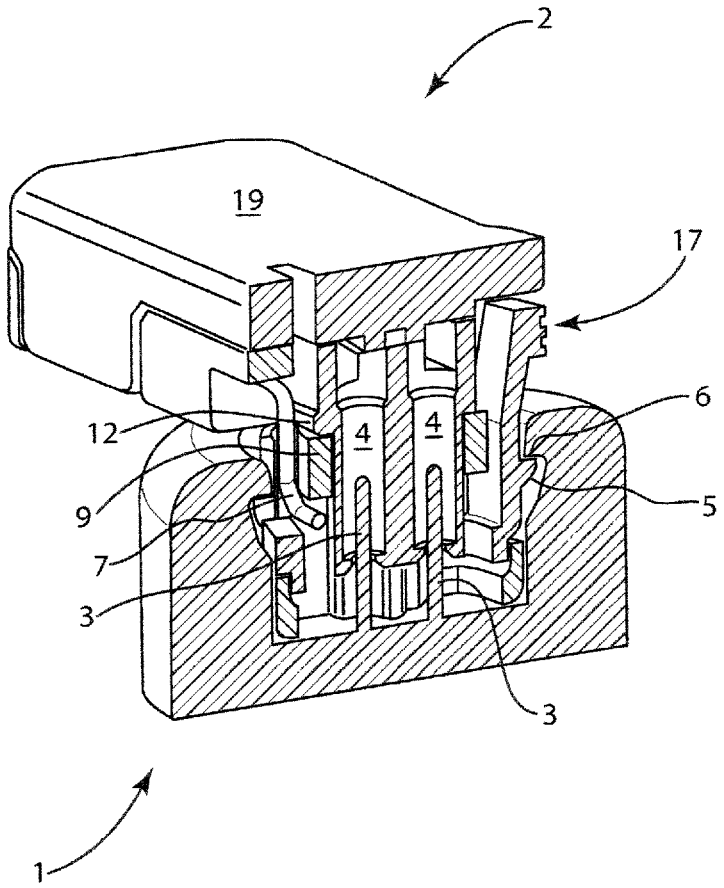
FIG. 8 is a perspective view of the squib assembly and squib connector of the electrical connector of the invention, having a portion in cross-section, at the fully mated and locked insertion position, for indicating a method of releasing the squib connector.

To remove the squib connector from the squib assembly, it is only necessary to press release lever 17, as shown in FIG. 8, to release lock lever 5 from engagement with lip 6.

The present invention is not limited to the above-described embodiments and various modifications in design, structural arrangement or the like may be used without departing from the scope or equivalents of the present invention.

The invention claimed is:

1. An electrical connector, comprising:

a squib connector of an electrical insulating material for housing a plurality of socket contacts;

a squib assembly of an electrical insulating material for housing a plurality of pin contacts for insertion in the socket contacts when the squib connector and squib assembly are moved together in a mating direction and mated;

a retaining means for retaining the squib connector and squib assembly in a fully mated condition, the retaining means being self activated when the squib connector and squib assembly are fully mated;

a spring, acting in a direction opposite the mating direction, to provide a resisting force to oppose mating, the spring being separate from the squib connector, wherein during the application of a mating force to overcome the resisting force of the spring and move the squib connector and squib assembly in the mating direction, and prior to the squib connector and squib assembly reaching the fully mated condition, removal of the resisting force of the spring is triggered and the mating force is instantly applied to moving the squib connector and squib assembly to the fully mated condition, whereat the retaining means is activated.

2. The electrical connector of claim 1, wherein:

the spring is formed to provide a resistance force when an upper portion of the spring is moved toward a lower portion of the spring;

the upper portion of the spring bears on the squib connector;

the squib assembly includes a ledge; and the lower portion of the spring bears on the ledge.

3. The electrical connector of claim 2, wherein:

the squib connector includes a spring activator; and during movement of the squib connector and squib assembly in the mating direction, the spring activator contacts the spring to displace the spring from the ledge, thereby removing the resisting force of the spring.

4. The electrical connector of claim 1, wherein the retaining means comprises:

a lip on the squib assembly; and a lock lever on the squib connector, the lock lever being biased toward the lip and free to engage the lip, during mating, only when the squib connector and squib assembly are fully mated.

5. The electrical connector of claim 2, wherein:

the spring is fabricated of a spring material having the form of a wire, with the wire being configured to be disposed substantially in a single plane.

6. The electrical connector of claim 2, wherein:

the spring is fabricated of a spring material having the form of a wire, with the wire being configured to have the lower portion and a part of the upper portion disposed substantially in a a single plane, and a remaining part of the upper portion disposed in a plane perpendicular to the single plane.

7. The electrical connector of claim 1, wherein the spring is a metallic spring.

* * * * *